US009038521B1

(12) United States Patent
Rollins et al.

(10) Patent No.: US 9,038,521 B1
(45) Date of Patent: May 26, 2015

(54) APPARATUS FOR CREATING AND CUSTOMIZING INTERSECTING JETS WITH OILFIELD SHAPED CHARGES

(71) Applicant: GEODynamics, Inc., Millsap, TX (US)

(72) Inventors: James A. Rollins, Millsap, TX (US); Kevin R. George, Millsap, TX (US); Nathan Clark, Millsap, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 14/176,056

(22) Filed: Feb. 8, 2014

(51) Int. Cl.
*E21B 43/117* (2006.01)

(52) U.S. Cl.
CPC ..... *E21B 43/117* (2013.01)

(58) Field of Classification Search
USPC ..... 89/1.151, 1.15; 175/4.6; 166/55, 55.1, 166/63, 171, 297
See application file for complete search history.

(56) References Cited

U.S. PATENT DOCUMENTS 4,753,301 A * 6/1988 Berry ..... 175/4.6
5,590,723 A * 1/1997 Walker et al. ..... 175/4.6
7,735,578 B2 * 6/2010 Loehr et al. ..... 175/4.6
8,127,848 B2 * 3/2012 Myers et al. ..... 166/297
2005/0109501 A1 * 5/2005 Ludwig ..... 166/55
2013/0206385 A1 * 8/2013 Feng et al. ..... 166/55
2014/0041515 A1 * 2/2014 Mauldin ..... 89/1.15

OTHER PUBLICATIONS

Bruyere, Clark, Stirton, Kusumadjaja, et al., New Practices to Enhance Perforating Results, Oilfield Review, Autumn 2006, pp. 18-35, V. 18 No. 3, Schlumberger, Houston, Texas.
Bersas, Stenhaug, Doornbosch, Langseth, Fimreite, Parrott, Perforations on Target, Oilfield Review, Spring 2004, pp. 28-37, V. 16 No. 1, Schlumberger, Houston, Texas.
Triple-Jet™ Perforating System, Halliburton, Jul. 2007, U.S.A.
Scott, Carvajal, Manning, Hendry, et al., A New Multi-Jet Gun Improves Well Production, Society of Petr Engineers, Deepwater Drilling and Completions Conf, Oct. 2010, Texas.

* cited by examiner

*Primary Examiner* — J. Woodrow Eldred
(74) *Attorney, Agent, or Firm* — David W. Carstens; Sudhakar V. Allada; Carstens & Cahoon, LLP

(57) ABSTRACT

A geological perforating tool (gun) shape charges disposed at an angle that provides an improvement over other known embodiments by accurately securing the charges in the tool to facilitate reliable, reproducible focus of the shaped charges. Charges are disposed on metal strips fitted into slots that are precision cut at predetermined angles in a tool barrel circumference.

10 Claims, 3 Drawing Sheets

APPARATUS FOR CREATING AND CUSTOMIZING INTERSECTING JETS WITH OILFIELD SHAPED CHARGES

BACKGROUND

1. Field of the Invention

The present invention relates generally to perforation guns that are used in the oil and gas industry to explosively perforate well casing and underground hydrocarbon bearing formations, and more particularly to an improved apparatus for explosively perforating a well casing and its surrounding underground hydrocarbon bearing formation in intersecting perforations.

2. Background

A common method of perforating oil bearing geological formations is by shooting holes through the well casing by means of a special gun that is lowered into the hole. "During the completion of an oil and/or gas well, it is common to perforate the hydrocarbon containing formation with explosive charges to allow inflow of hydrocarbons to the well bore. These charges are loaded in a perforation gun and are typically shaped charges that produce an explosive formed penetrating jet in a chosen direction" U.S. Pat. No. 7,441,601.

The employment of angled shape charge placement to provide intersecting perforations has generated great interest in recent years. See for example, *Triple-Jet® Perforating System*, a paper by Halliburton, Bersas, et al, *Perforation on Target*, Oilfield Review, and *New practices to Enhance Perforating Results*, Oilfield Review. (all included in the information Disclosure material of this application). The intersecting perforation assist in cleaning the debris from the perforated channel and are especially useful where there is crushed or loose material adjacent the well bore where the perforation is to be made and in sand formations.

However there is needed a more reliable and effective tool for effecting angled perforations. The present invention is such a tool.

SUMMARY

A geological perforating too (gun) with improved method of placing shape charges at an angle in the tool barrel that provides an improvement over other known embodiments by securely and accurately securing the charges in the tool to facilitate reliable, reproducible focus of the shaped charges at a variable distance into the formation.

DESCRIPTION OF THE FIGURES

A more complete understanding of the method and apparatus of the present invention may be had by reference to the following detailed description when taken in conjunction with the accompanying drawings, wherein.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION

This invention provides an improved tool (gun) and method of installing shaped charges at variable angles within a carrier assembly in order to cause two or more perforating tunnels to intersect at a prescribed distance outside of the well casing. All known current methods require special tooling that have long and costly lead times and are deficient in actually securing the angle of intercept. Embodiments of tools of the invention help to ensure that the charges collide at the prescribed location outside of the casing. The disclosed apparatus (tool) is comprised of a support strip that is welded or otherwise secured into a tubular support. The spacing between each charge on the support can be adjusted and the flat support base can be inserted at various angles within the support member to accurately control the point of intersection. This flat surface provides a solid base for securing the shaped charge and the round tubing provide the structure needed to form a rigid geometric frame. A flat support strip is described and preferred but concave or convex geometries can also be utilized as the support base to optimize charge performance. This system provides an improvement over other known embodiments by securely and accurately focusing the shaped charges at a variable distance into the formation.

In broad scope the perforating tool of this invention comprises;

a cylindrical barrel having angled circular cutouts for placement of shaped charges in shape charge cases;

support strips comprising metal strips with a centered hole to receive a shape charge case, wherein the shape charge case has a circumferential projection that will not pass through the hole and provides support for a shaped charge case on the strip;

slots cut into the cylindrical barrel to support the edges of the support strips, cut at a predetermined angle to provide location for perforations from the shaped charges.

Figure 6:
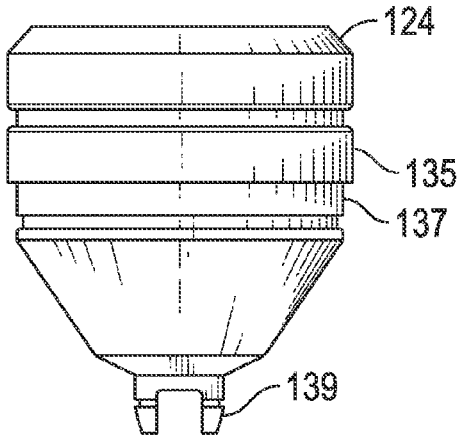
FIG. 6 is a side view of a shaped charge suitable for use in embodiments of the invention.

Referring to FIGS. 1-5 there is illustrated the gun assembly, 100, of an embodiment of the invention. As shown there is the cylindrical gun body, 130, with the barrel (load tube) 126 disposed inside. The barrel, 126, has multiple precision cut slots, 127 that allow the charge case 124 to be inserted into the barrel 126 and subsequently rest on the support strip 128. The holes may be located on any side of the circumference of the barrel to achieve the desired target perforations. The holes are preferably cut through the barrel wall at an angle perpendicular (900) to the plane of the orientation of the support strip. A shaped charge case, 124, is disposed in a hole in a support strip (128), resting on a projection, 135, on the circumference of the charge case (see FIGS. 5 and 6). The shape charge case (FIG. 6) has a projection 135 that is larger diameter than the hole in the support strip so that the bottom of this projection (135) rest on the sided of the hole in the support strip. The charge is connected to a detonating cord (or other detonating means) at 139. The charge case is secured to the support strip (128,129) by any suitable means. In a prototype (and possible production model) there is a thin strip cut into the inside barrel wall that may be bent over to press against the top of the charge case projection and thus provide reversible securement means. The charge case may be secured by small clamps, by adhesive or by welding. Other means will be obvious to those skilled in the metal fabrication art.

The support strips (128,129) are inserted into slots cut into the barrel. The support strip will generally be flat metal pieces but may also be curved. Slots in the barrel are angled as desired to allow any configuration of slanted charge paths. If the support strips are metal (preferred) they will be welded into the slots, but they may also be attached by other means such as a strong adhesive, a locking mechanism built into the slots and support strips or any other means that will achieve a secure attachment as will be apparent to those skilled in the art. This arrangement of charge cases securely rested and secured on the support plates, together with the ability to angle the flat plated into the barrel at any desired angle provides the means of relatively simple, precise and reliable angled charge placemat and therefore perforation placement.

Figure 1:
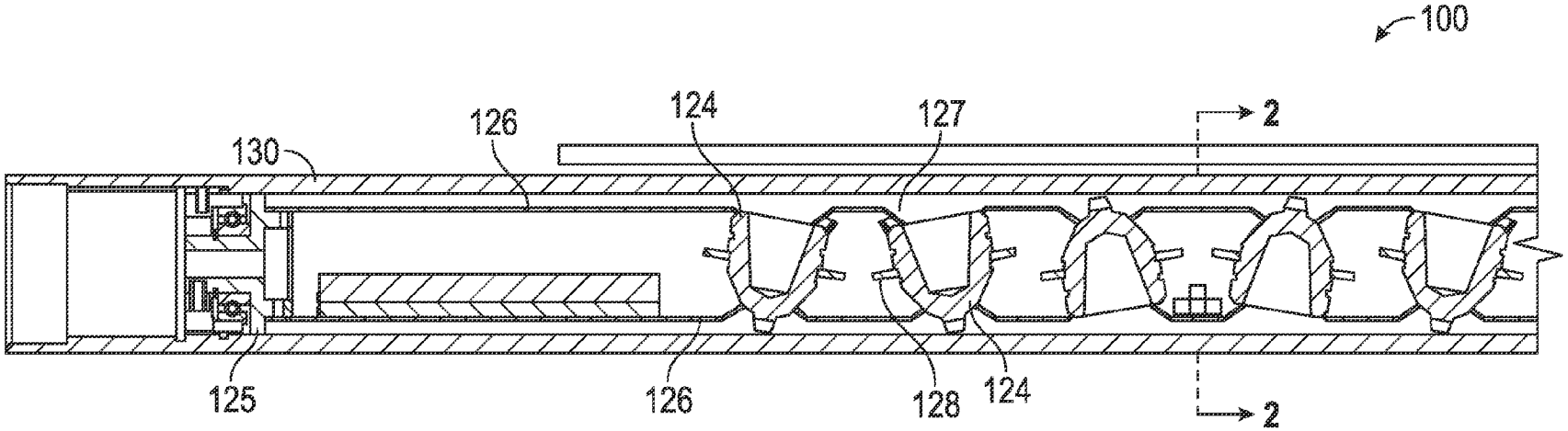
FIG. 1 is a sectional view of an embodiment of a perforation gun assembly of the invention.
Figure 2:
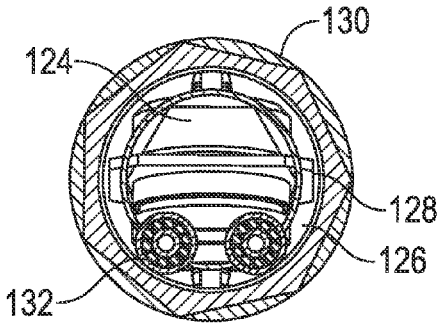
FIG. 2 is an end view of the perforating gun shown in FIG. 1.
Figure 3:
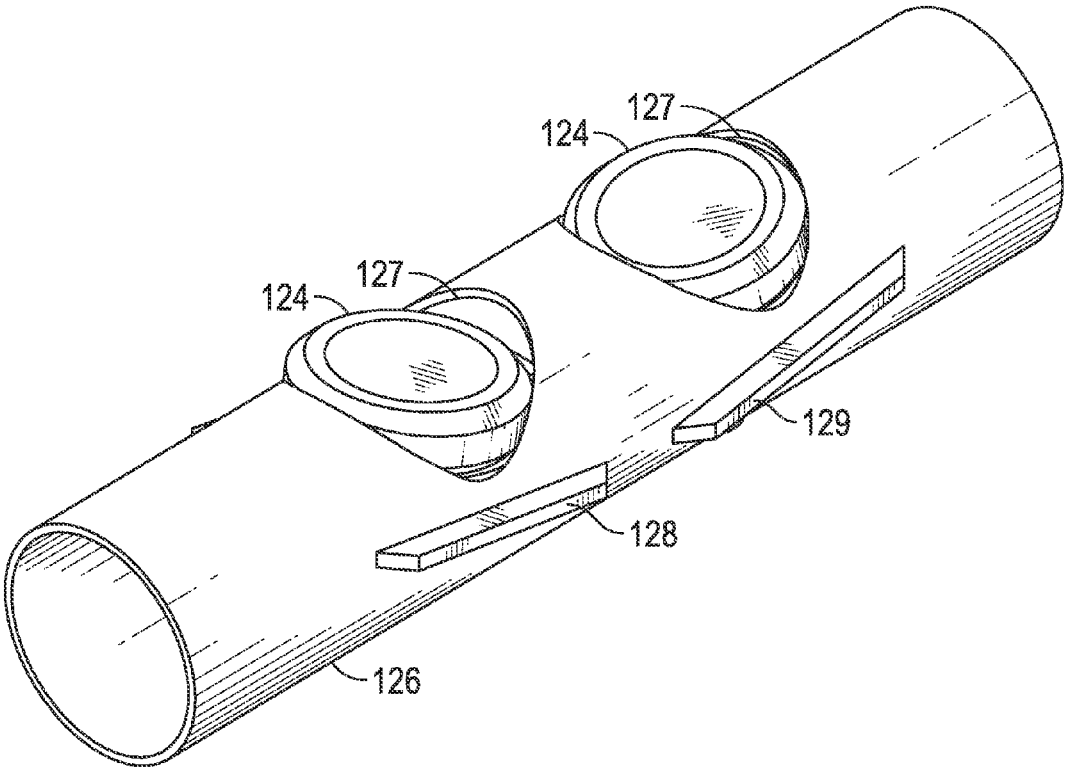
FIG. 3 is a perspective view of the barrel and shaped charges of an embodiment of the invention.
Figure 4:
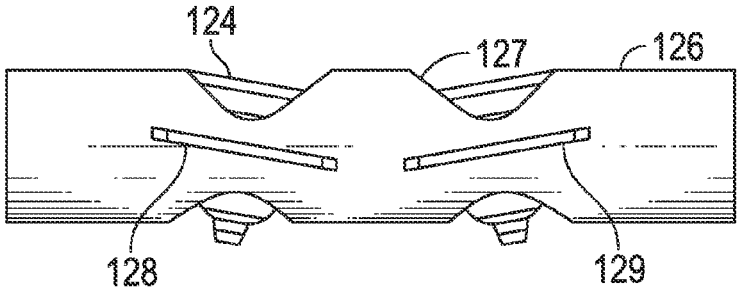
FIG. 4 is aside view of the embodiment of FIG. 3.
Figure 5:
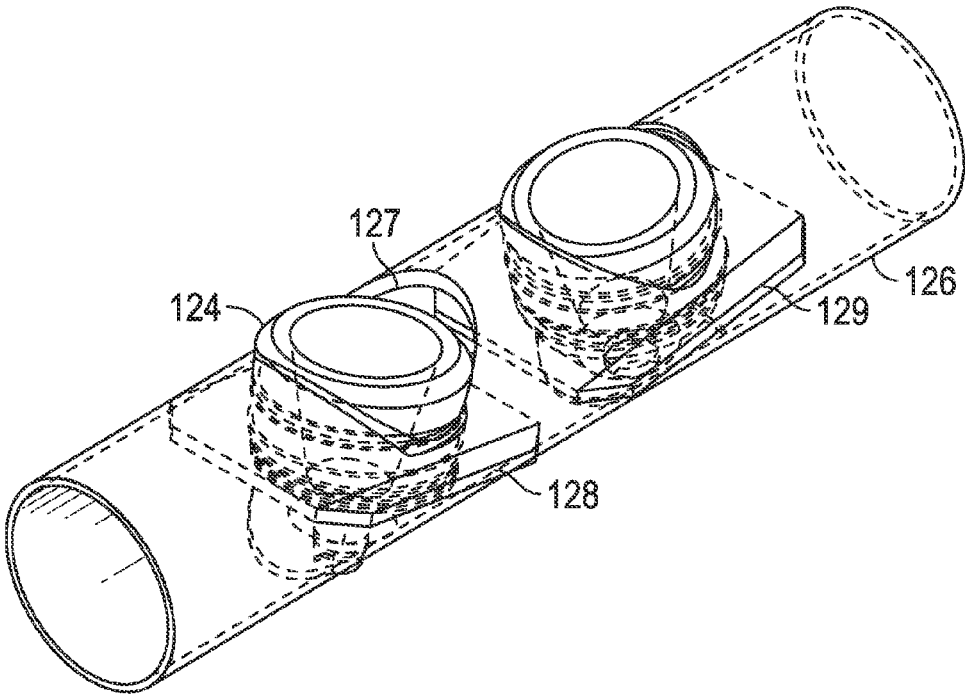
FIG. 5 is a perspective view of a barrel of an embodiment of the invention showing placement of shaped charges on a support strip.

The barrel is secured in gun body at each end as shown in FIGS. 1 and 2 (125 and 132) or by other suitable means within the skill of those skilled in the art.

Computer aided laser machining greatly facilitated the precision and reliability of the cuts needed in manufacturing the tools of embodiments of this invention, particularity the barrel cut openings (127) and the slots for the charge plate.

In operation the desired angles are predetermined to achieve the desired perforation intersection pattern and the barrel cuts designed and machined accordingly. The barrel is disposed in a gun body for use in a well bore.

Although the invention hereof has been described by way of preferred embodiments, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

The invention claimed is:

1. A perforating tool comprising:

a cylindrical barrel having angled circular cutouts for placement of shaped charges in shape charge cases;

support strips comprising metal strips with a centered hole to receive a shape charge case, wherein the shape charge cases have a circumferential projection that will not pass through the hole and which provides support for a shaped charge case on the strip;

slots cut into the cylindrical barrel to support the edges of the support strips, cut at a predetermined angle to provide angled direction for perforations in a geological formation from explosion of the shaped charges.

2. The perforating tool of claim 1 wherein there is a thin strip cut into the inside barrel wall that may be bent over to press against the top of a charge case projection to provide reversible securement means.

3. The perforating tool of claim 1 wherein the charge cases are secured to the support strip by small clamps, by adhesive or by welding.

4. The perforating tool of claim 1 wherein slots in the barrel are produced by computer aided laser machining.

5. The perforating tool of claim 1 wherein the support strips are curved.

6. The perforating tool of claim 1 wherein the support strips are welded into the slots in the barrel.

7. The perforating tool of claim 1 wherein there is provides means to attach the barrel with shaped charges into a well casing string.

8. A method of producing intersecting perforations in a geological formation comprising providing a perforating gun disposed at a desire location comprising:

a cylindrical barrel having angled circular cutouts for placement of shaped charges in shape charge cases;

support strips comprising metal strips with a centered hole to receive a shape charge case, wherein the shape charge cases have a circumferential projection that will not pass through the hole and which provides support for a shaped charge case on the strip;

slots cut into the cylindrical barrel to support the edges of the support strips, cut at a predetermined angle to provide angled direction for perforations in a geological formation from explosion of the shaped charges; and detonating the shaped charges.

9. The method of claim 8 wherein the charge cases are secured to the support strip by thin strips cut into the inside barrel wall that may be bent over to press against the top of a charge case, or by small clamps, or by adhesive or by welding.

10. The method of claim 8 wherein the support strips are welded into the slots in the barrel.

* * * * *